United States Patent [19]

Vornberger

[11] 3,992,743

[45] Nov. 23, 1976

[54] ROUGHING MACHINE WITH DAMPER MECHANISM

[75] Inventor: Walter Vornberger, Tewksbury, Mass.

[73] Assignee: International Shoe Machine Corporation, Nashua, N.H.

[22] Filed: Apr. 12, 1976

[21] Appl. No.: 676,031

[52] U.S. Cl. ..... 12/1 R

[51] Int. Cl.[2] ..... A43D 00/00

[58] Field of Search ..... 12/1 R, 1 B, 1 W, 17 R; 69/6.5

[56] References Cited

UNITED STATES PATENTS

| | | | |
|---|---|---|---|
| 3,780,390 | 12/1973 | Braum | 12/1 R |
| 3,843,985 | 10/1974 | Leonhardt | 12/1 R |
| 3,932,907 | 1/1976 | Vornberger | 12/1 R |

*Primary Examiner*—Patrick D. Lawson
*Attorney, Agent, or Firm*—Albert Gordon

[57] ABSTRACT

A roughing machine for roughing the margin of an upper that is moved past a roughing tool of the roughing machine. The roughing tool is incorporated in a roughing tool assembly that is yieldably urged downwardly against the upper margin under relatively low pressure. A damper mechanism has a follower element in engagement with the roughing tool assembly. The damper mechanism is so constructed that the follower element provides a resistance to upward movement of the roughing tool assembly of a relatively high magnitude and a downward force of a relatively low magnitude is imparted to the follower element.

2 Claims, 10 Drawing Figures

ROUGHING MACHINE WITH DAMPER MECHANISM

BACKGROUND OF THE INVENTION

U.S. Pat. applications Ser. No. 608,616 filed Aug. 2, 1975 and Ser. No. 621,188 filed Oct. 9, 1975 show a roughing machine that includes a support for supporting bottom-up a shoe assembly that includes the margin of an upper. A roughing tool assembly, that includes a roughing tool, is located above the upper margin and is mounted for heightwise movement. Means are provided to so move the support as to move successive segments of the upper margin past the roughing tool. A yieldable force applying means is so connected to the roughing tool assembly as to yieldably urge the roughing tool downwardly against the upper margin to thereby enable the roughing tool to rough the upper margin segments.

The roughing tool is yieldably urged downwardly against the upper margin under relatively low pressure to prevent the roughing tool from penetrating too deeply into the upper margin and thereby unduly shred the upper margin. When a segment of the upper margin of higher elevation than its preceding segment, such as the ridge of a seam, is presented to the roughing tool, the roughing tool is caused to move upwardly against the yieldable pressure urging it downwardly. Because this pressure is relatively low, the roughing tool has a tendency to bounce upwardly of the upper margin and then settle down against the upper margin after a portion of the upper margin has passed the roughing tool, thus leaving an unroughed segment of the upper margin.

SUMMARY OF THE INVENTION

In order to overcome the defect referred to in the preceding paragraph, the roughing machine has been provided with a damper mechanism that has a follower element in engagement with the roughing tool assembly. The damper mechanism is so constructed as to provide a resistance to upward movement of the follower element of relatively high magnitude pursuant to upward movement of the follower element caused by the movement of the higher elevation segment of the upper margin past the roughing tool and to impart a downward force of relatively low magnitude to the follower element to enable the follower element to engage the roughing tool assembly.

DESCRIPTION OF THE PREFERRED EMBODIMENT

Figure 1:
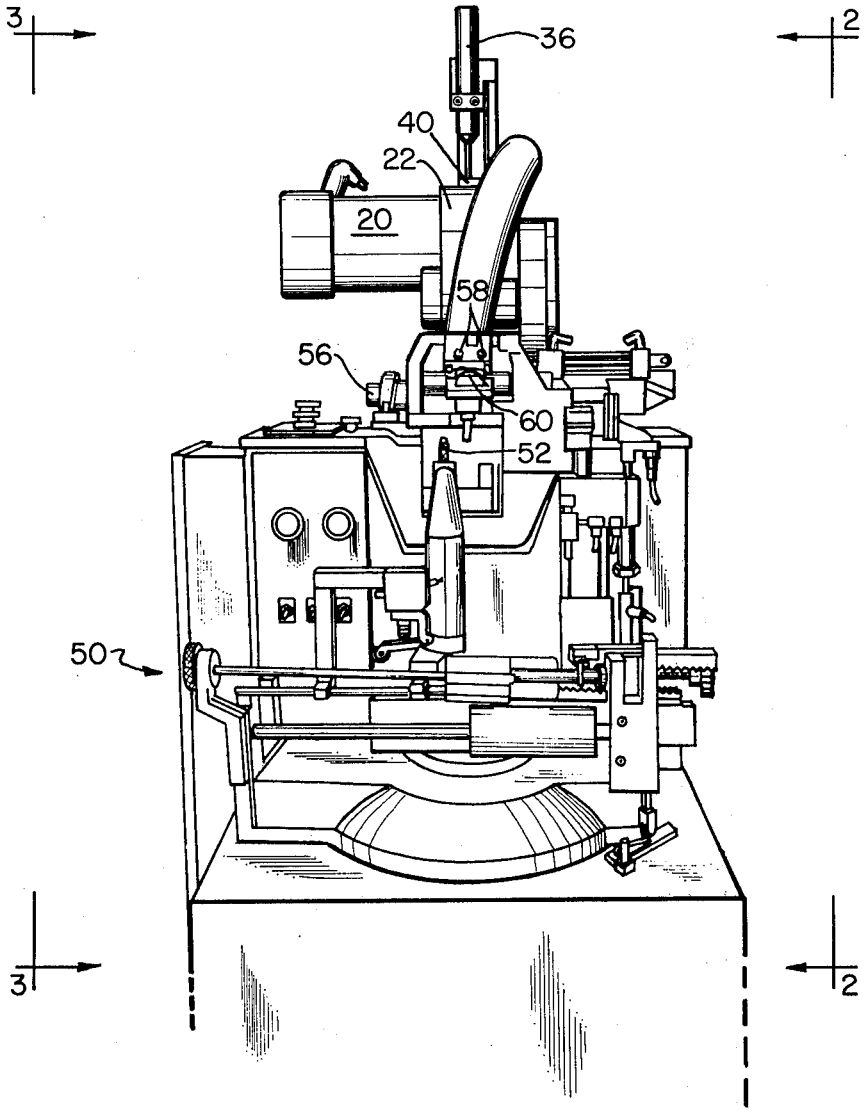
FIG. 1 is a front elevation of the machine.
Figure 2:
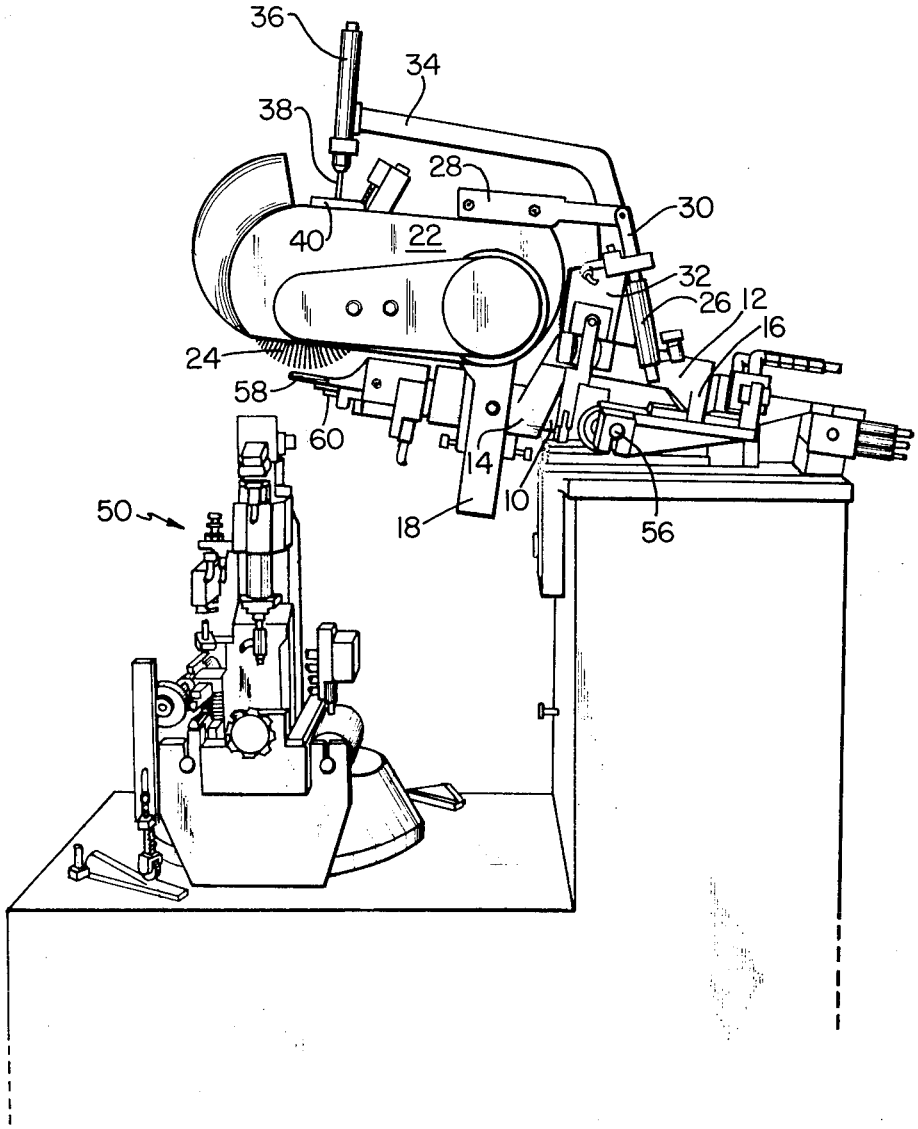
FIGS. 2 and 3 are side elevations of the machine respectively taken along the lines 2—2 and 3—3 of FIG. 1.
Figure 3:
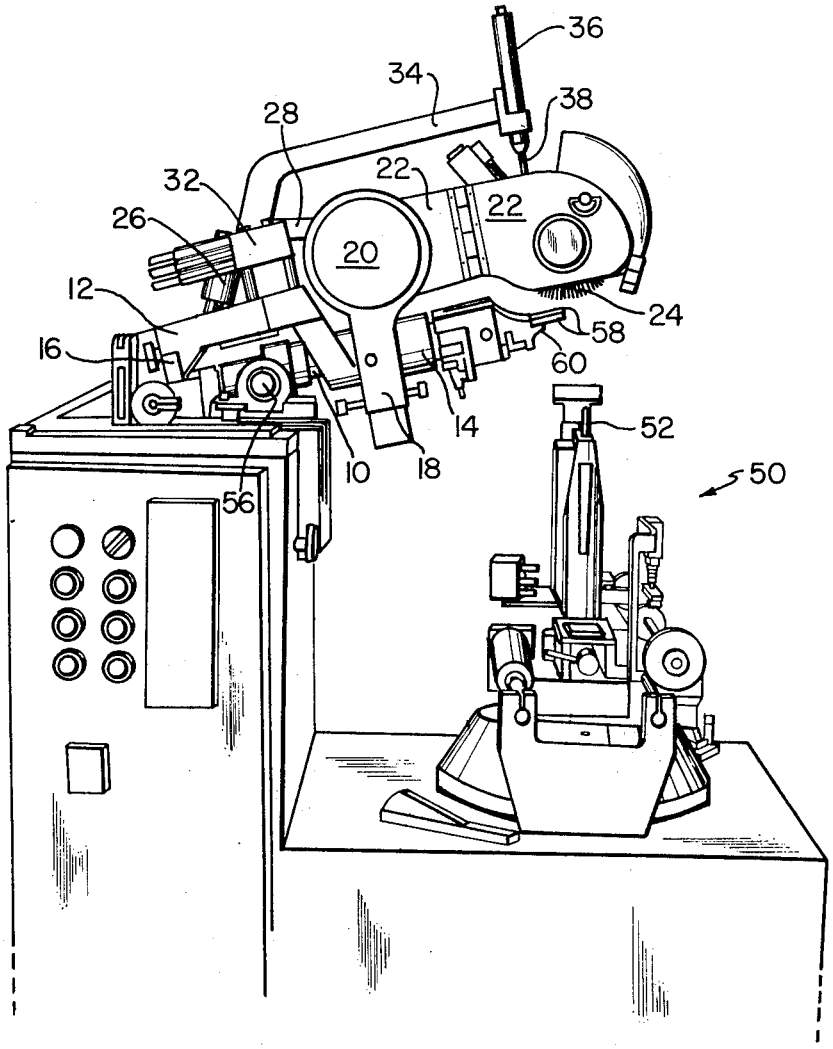
Figure 4:
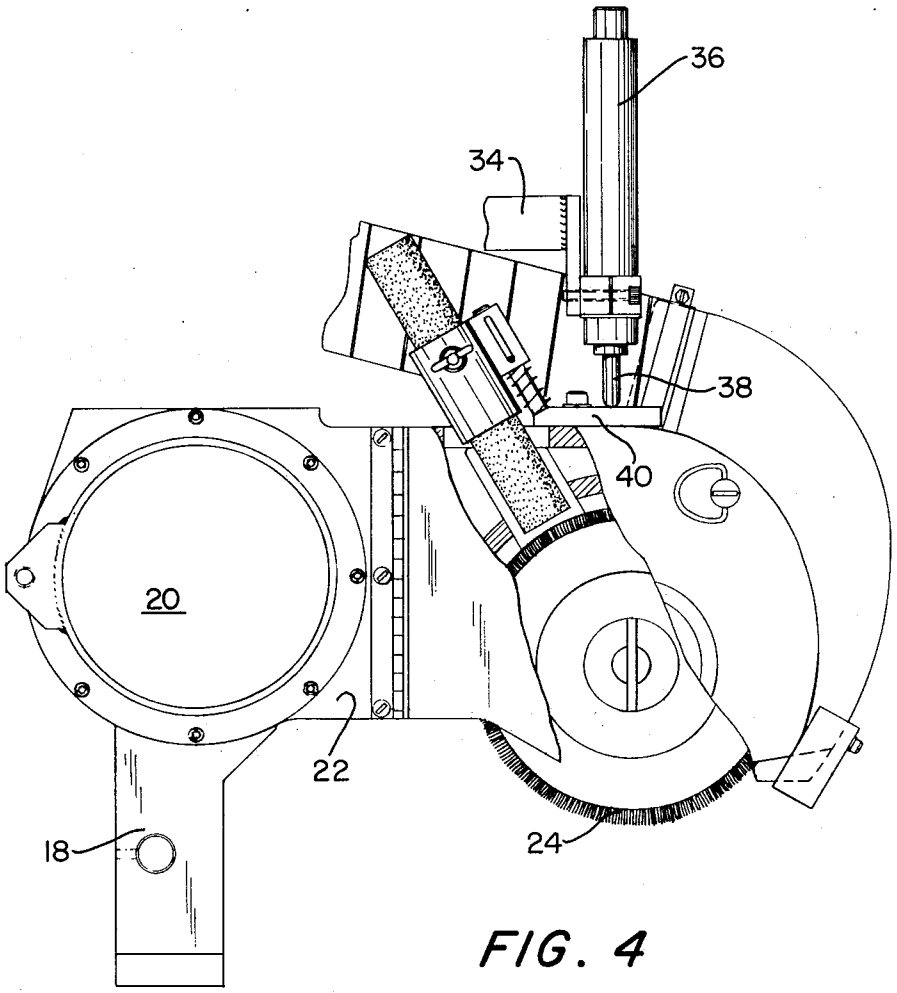
FIG. 4 is a side elevation of the roughing tool assembly.

The operator is intended to stand in front of the machine as seen in FIG. 1, to the left of the machine as seen in FIG. 2 and to the right of the machine as seen in FIG. 3. Directions extending toward the operator will be designated as "forward" and directions extending away from the operator will be designated as "rearward". The front of the machine is closest to the operator and the back of the machine is furthermost from the operator.

Referring to FIGS. 1–4, the machine includes a shaft 10 to which a bracket 12 is rotatably mounted by means of a front trunnion 14 and a back trunnion 16 on the bracket. A mount 18 is mounted to the front trunnion 14. An electric motor 20 is rigidly mounted to the mount 18 above the front trunnion 14. A housing 22 is rotatably mounted to the motor 20 for heightwise swinging movement about the horizontal axis of the motor 20. The front of the housing 22 rotatably mounts a roughing tool in the form of a wire brush 24. The motor 20 and the brush 24 are drivingly connected by a belt (not shown) so as to enable the motor to rotate the brush. An air operated motor 26 is interposed between the bracket 12 and a beam 28 that is secured to the housing 22 with the upwardly projecting piston rod 30 of this motor being connected to the beam 28 so that the motor 26 may effect heightwise movement of the brush 24 about the axis of the motor 20.

A block 32 is anchored to the front of the bracket 12 and a lug 34 is secured to and extends forwardly of the block 32 above the housing 22. An hydraulic check 36 is mounted to the front of the lug 34 above the housing 22. A downwardly extending plunger 38 of the hydraulic check 36 is in engagement with a plate 40 that is secured to the top of the housing 22. The hydraulic check 36 is a standard commercial item that is supplied by the Aro Corporation of Bryan, Ohio.

In the idle condition of the machine: the electric motor 20 is operative to rotate the brush 24; and the piston rod 30 is retracted into the motor 26 to thus position the brush 24 in a relatively elevated position with the plunger 38 of the hydraulic check 36 bearing against the plate 40.

Figure 5:
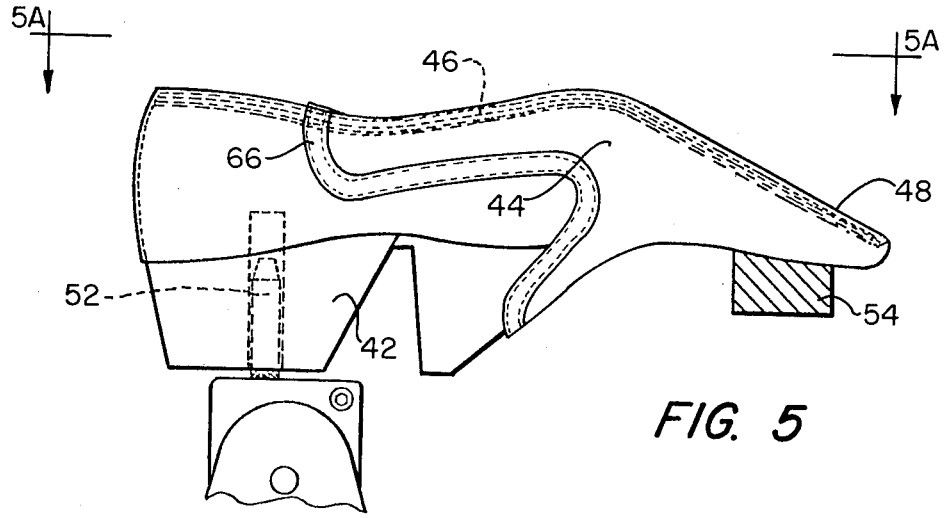
FIG. 5 is a side elevation of a shoe assembly mounted in the machine.
Figure 5A:
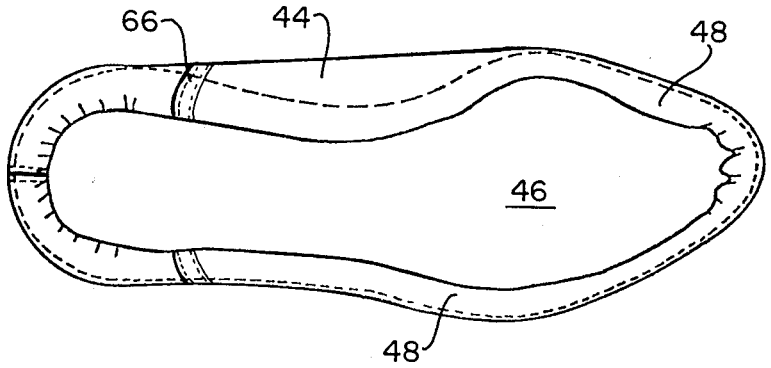
FIG. 5A is a view taken along the line 5A—5A of FIG. 5.

FIGS. 5 and 5A show a shoe assembly that comprises a last 42 having an upper 44 mounted thereon and an insole 46 mounted to its bottom. The upper 44 has been lasted so that the upper margin 48 lies against and is secured to the insole and extends inwardly of the periphery of the insole and of the shoe assembly bottom.

The machine incorporates a shoe assembly mount section 50 (see FIGS. 1–3) that is shown in greater detail in applications Ser. Nos. 608,616 and 621,188 and that includes a last pin 52 and a top pad 54. In the manner shown in applications Ser. Nos. 608,616 and 621,188, the shoe assembly is mounted bottom-up on the last pin 52 and the toe pad 54 to assume the position shown in FIG. 5.

The shaft 10 is mounted for forward-rearward movement and for heightwise swinging movement about the axis of spindles 56 (FIGS. 1–3). A pair of fork tines 58 are anchored to the front of the shaft 10 and a sensing member 60 is located beneath the fork tines 58 and is mounted for forward-rearward movement with respect to the shaft 10.

Figure 6:
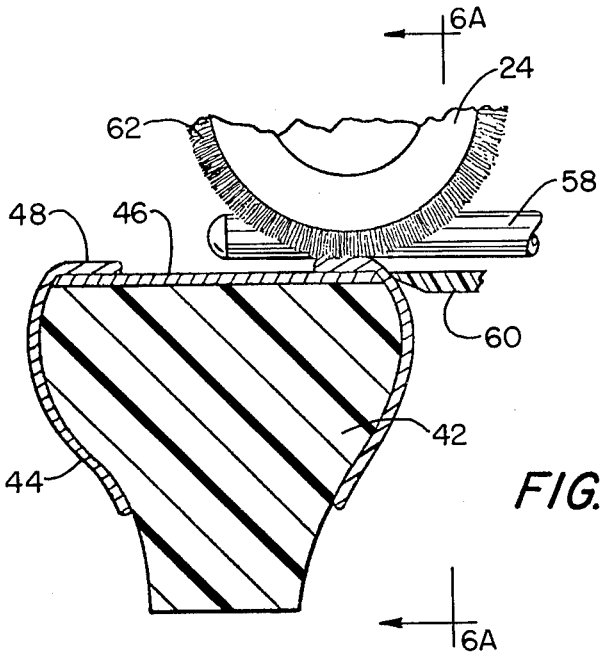
FIG. 6 is a section showing the shoe assembly and the shoe assembly engaging parts of the machine at the beginning of a roughing operation.

After the shoe assembly is mounted to the last pin 52 and the toe pad 54 of the section 50, the fork tines 58 and the sensing member 60 are brought to the FIGS. 6 and 6A position wherein the fork tines 58 engages the upper margin 48 in one of its breast line regions and the sensing member 60 engages the side of the shoe assembly below the fork tines 58. This is followed by an actuation of the motor 26 to project its piston rod 30 upwardly and thus lower the brush 24 into engagement with the upper margin 48 under the yieldable force of pressurized air from the motor 26 to thus cause radially projecting bristles 62 of the brush 24 to engage the upper margin 48 between the fork tines 58, as indicated in FIGS. 6 and 6A.

Now, in the manner shown in application Ser. No. 608,616, the section 50 and the shoe assembly are so moved as to move the entire upper margin 48 past the rotating brush 24 so as to enable the rotating bristles 62 to abrade or rough the upper margin. During this movement, the front of the shaft 10 must move upwardly and downwardly about the axis of the spindles 56 to thereby provide for upward and downward movement in accordance with the elevation of the portion of the upper margin being roughed, the shaft 10 must move forwardly and rearwardly to thereby position the brush 24 the desired distance inwardly of the outer periphery of the portion of the upper margin being roughed, and the central plane of the brush 24, indicated by the chain line 64 in FIG. 6A, should be tilted so as to be at right angles to the plane of the portion of the upper margin being roughed. These upward-downward, forward-rearward and tilting movements of the brush 24 are accomplished by the mechanisms disclosed in application Ser. No. 608,616 and/or U.S. Pat. No. 3,843,985.

During the movement of the upper margin 48 past the brush 24, the brush is yieldably urged downwardly under the force of pressurized air against the upper margin by the motor 26. In order to prevent the bristles 62 from penetrating too deeply into the upper margin and thereby unduly shredding the upper margin, the downward pressure applied by the motor 26 is relatively low.

Figure 6A:
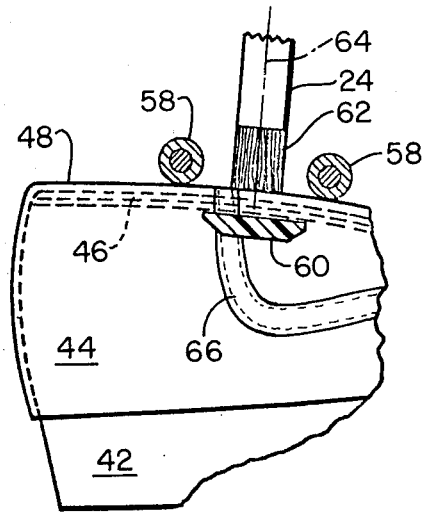
FIG. 6A is a view taken along the line 6A—6A of FIG. 6.
Figure 7:
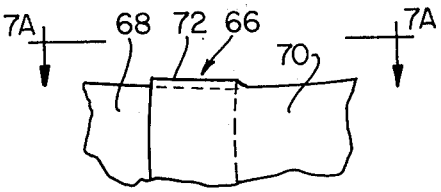
FIG. 7 is a side elevation, to an enlarged scale, of a segment of the upper margin having a seam.
Figure 7A:
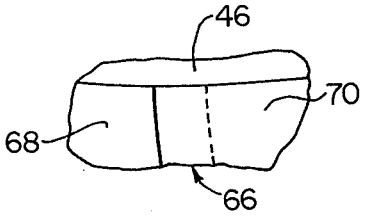
FIG. 7A is a plan view taken along the line 7A—7A of FIG. 7.

As shown in FIGS. 5, 5A and 6A, the upper 44 has a seam 66 therein which is shown on a larger scale in FIGS. 7 and 7A. The seam 66 is formed by two overlapping segments 68 and 70 of the upper margin that are stitched to each other. As shown particularly in FIG. 7, the overlapping segments form an upwardly facing ridge 72 in the upper margin. When the ridge 72 moves past the brush 24, due to the low downwardly directed force applied to the brush 24 by the motor 26, the brush has a tendency to bounce upwardly of the upper margin and then settle down against the upper margin after a portion of the upper margin has passed the brush, thus leaving an unroughed segment of the upper margin. The hydraulic check 36 acts to prevent the occurrence of this unroughed segment of the upper margin in the manner described below.

The hydraulic check 36 is so constructed that a downward movement of a relatively low magnitude is imparted to the plunger 38 to maintain the plunger in engagement with the plate 40 and the plunger 38 offers resistance to upward movement of a relatively high magnitude. Therefore, when the brush 24 engages the ridge 72, the plunger 38 will rise at a relatively low rate and cease its upward movement immediately after the highest portion of the ridge 72 passes beneath the brush 24. When the ridge 72 has passed the brush 24, the hydraulic check 36 and the motor 26 act to lower the brush against the upper margin segment that next presents itself to the brush under a force that is not substantially greater than the low pressure force imparted by the motor 24.

After the entire upper margin 48 has been roughed, the movement of the section 50 and of the shoe assembly is terminated, the fork tines 58 and the sensing member 60 are disengaged from the shoe assembly, and the motor 26 is returned to its idle position to thereby raise the brush 24 away from the shoe assembly. The shoe assembly, with the roughed upper margin, is now removed from the machine.

There follows a recapitulation of the machine parts and the mode of operation of the machine that are pertinent to this invention.

The machine includes a support comprised of the last pin 52 and the toe pad 54 for so supporting bottom-up the shoe assembly that includes the upper margin 48 that the upwardly facing surface of the upper margin has segments of different elevations. The housing 22 and the roughing tool 24 mounted to the housing form a roughing tool assembly that is located above the upper margin and is mounted for heightwise movement. Means shown in application Ser. No. 608,616 so move the support as to move successive portions of the upper margin 48 past the roughing 24. The air operated motor 26, interposed between the bracket 12 and the housing 22, acts as a yieldable force applying means so connected to the roughing tool assembly as to yieldably urge the roughing tool 24 downwardly against the upper margin 48 under relatively low pressure.

The hydraulic check 36 acts as a damper mechanism and the plunger 38 acts as a follower element of the damper mechanism. The damper mechanism 36 is mounted to the bracket 12 and is located above the housing 22 with the follower element 38 in engagement with the housing 22. The damper mechanism 36 is so constructed as to provide a resistance to upward movement of the follower element 38 of relatively high magnitude pursuant to upward movement of the roughing tool assembly caused by the movement of a segment (the ridge 72) of the upper margin 48 of higher elevation than the preceding upper margin segment past the roughing tool 24 and to impart a downward force of relatively low magnitude to the follower element 38 to enable the follower element to engage the roughing tool assembly. I claim:

1. A roughing machine comprising: a support for so supporting bottom-up a shoe assembly that includes the margin of an upper that the upwardly facing surface of the upper margin has segments of different elevations; a roughing tool assembly, that includes a roughing tool, located above said margin and mounted for heightwise movement; means for so moving the support as to move successive segments of the upper margin past the roughing tool; yieldable force applying means so connected to the roughing tool assembly as to yieldably urge the roughing tool downwardly against the upper margin under relatively low pressure; and a damper mechanism having a follower element in engagement with the roughing tool assembly, said damper mechanism being so constructed as to provide a resistance to upward movement of the follower element of relatively high magnitude pursuant to upward movement of the roughing tool assembly caused by the movement of a segment of the upper margin of higher elevation than the preceding upper margin segment past the roughing tool and to impart a downward force of relatively low magnitude to the follower element to enable the follower element to engage the roughing tool assembly.

2. The machine of claim 1 further comprising: a bracket; wherein said roughing tool assembly comprises a housing mounted for said heightwise movement to which said roughing tool is mounted; wherein said yieldable force applying means comprises an air operated motor interposed between said bracket and said housing; and wherein said damper mechanism is mounted to said bracket and is located above said housing with said follower element in engagement with said housing.

* * * * *

UNITED STATES PATENT AND TRADEMARK OFFICE

CERTIFICATE OF CORRECTION

PATENT NO. : 3,992,743

DATED : November 23, 1976

INVENTOR(S) : Walter Vornberger

It is certified that error appears in the above-identified patent and that said Letters Patent are hereby corrected as shown below:

Column 4: Line 7, change "24" to --26--.

Signed and Sealed this

*Fourteenth* Day of *March 1978*

[SEAL]

*Attest:*

RUTH C. MASON
*Attesting Officer*

LUTRELLE F. PARKER
*Acting Commissioner of Patents and Trademarks*